US008466630B2

(12) United States Patent
Okamoto et al.

(10) Patent No.: US 8,466,630 B2
(45) Date of Patent: Jun. 18, 2013

(54) DISCHARGE LAMP LIGHTING APPARATUS

(75) Inventors: Masashi Okamoto, Hyogo (JP); Masaki Nakamura, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 246 days.

(21) Appl. No.: 13/064,821

(22) Filed: Apr. 19, 2011

(65) Prior Publication Data

US 2011/0254447 A1 Oct. 20, 2011

(30) Foreign Application Priority Data

Apr. 19, 2010 (JP) ..... 2010-095902

(51) Int. Cl.
*H05B 41/32* (2006.01)
*H01J 17/36* (2006.01)

(52) U.S. Cl.
USPC ..... 315/224; 315/84.51; 315/341

(58) Field of Classification Search
USPC ..... 315/84.51, 224, 207, 56, 63, 341, 315/349
See application file for complete search history.

(56) References Cited

U.S. PATENT DOCUMENTS

| | | | | |
|---|---|---|---|---|
| 6,849,831 | B2 | 2/2005 | Timans et al. | |
| 2006/0170375 | A1 * | 8/2006 | Okamoto et al. | 315/291 |
| 2006/0175984 | A1 * | 8/2006 | Okamoto et al. | 315/307 |
| 2009/0166351 | A1 | 7/2009 | Yokomori | |

FOREIGN PATENT DOCUMENTS

| | | | |
|---|---|---|---|
| JP | 2002-198322 | A | 7/2002 |
| JP | 2005-527972 | A | 9/2005 |
| JP | 2009-164080 | A | 7/2009 |

* cited by examiner

*Primary Examiner* — Daniel D Chang
(74) *Attorney, Agent, or Firm* — Rader, Fishman & Grauer PLLC

(57) ABSTRACT

A discharge lamp lighting apparatus includes a capacitor, a charge circuit for charging the capacitor, a switching element, a gate driving circuit that controls ON and OFF states of the switching element, a simmer current supply circuit for passing simmer current through a discharge lamp, a starting circuit that impresses high voltage to a starting electrode, and an electric discharge sequence control circuit that generates the gate signal and the starting signal. When lighting the discharge lamp, a sequence of the gate signal corresponding to an alternating repetition of the ON and OFF states of the switching element is generated. Before outputting the starting signal, the switching element is ON as a stand-by state. Then the sequence starts when the starting signal is outputted.

7 Claims, 5 Drawing Sheets

DISCHARGE LAMP LIGHTING APPARATUS

CROSS-REFERENCES TO RELATED APPLICATION

This application claims priority from Japanese Patent Application Serial No. 2010-095902 filed Apr. 19, 2010, the contents of which are incorporated herein by reference in their entirety.

TECHNICAL FIELD

The present invention relates to a discharge lamp lighting apparatus for lighting a flash discharge lamp, which can be used in a heating apparatus, an annealing apparatus, and the like used for a process for manufacturing a semiconductor and a thin film transistor.

BACKGROUND

As described in Japanese Patent Application Publication No. 2002-198322, a flash lamp is used so as to heat, at high speed, a substrate for ion implantation in a surface of a semiconductor wafer or impurity activation therein. Moreover, as described in Japanese Patent Application Publication No. 2005-527972, in another conventionally known technology, preheating is performed in addition to such rapid heating by using a halogen lamp. An advantage of using a flash lamp for heating a substrate is that it is possible to suppress excessive diffusion of the impurities to be activated, in the depth direction of a semiconductor, since heating is performed quickly so that the process can be completed for a short time.

In a general flash lamp, a pair of main electrodes (E1, E2) for flash discharge light emission i.e., main discharge, is arranged to face each other in an electrical discharge space (Ds), and a starting electrode (Et) is provided outside the lamp bulb so as not to be in contact with the electrical discharge space (Ds). A lighting circuit therefor has a main capacitor (Cz) for accumulating electric charges for main electric discharge, a charge circuit (Ux) for charging the main capacitor (Cy), and a starting circuit (Ut), which impresses high voltage to the starting electrode (Et). The main electrodes (E1, E2) of the lamp are connected to the respective (both) terminals of the main capacitor (Cz), wherein when the starting circuit (Ut) is activated in a state where charging of the main capacitor (Cz) is completed, the high voltage is impressed to the starting electrode (Et), so that dielectric barrier discharge occurs in the electrical discharge space (Ds) of the lamp, whereby main discharge is induced and generated by plasma produced due to this electric discharge between the main electrodes (E1, E2), so that the lamp can be turned on.

Although voltage of the main capacitor starts decreasing since the energy accumulated in the main capacitor is released from the lamp when the main discharge starts, lamp current gradually increases, reaches a peak, and then starts gradually decreasing since an increase rate of the lamp current after the start of the main discharge is controlled to fall within a predetermined range by usually inserting an inductor in a path connecting the main capacitor and the lamp. If the voltage impressed to the lamp from the main capacitor becomes less than the minimum voltage value, at which electric discharge can be maintained, or if the current, which flows into the lamp, becomes less than the minimum current value, at which electric discharge can be maintained, electric discharge stops so that the lamp goes out.

Various proposals for measures and improvements of such a heating apparatus and annealing apparatus are made to practically use substrate heating, in which a flash lamp is used. For example, Japanese Patent Application Publication No. 2009-164080 discloses proposed technology, in which when simmer discharge is generated on a lower side in gravity just before main discharge to extend the life-span of a lamp, and electric discharge floats up even near the arc tube axis due to heat convection in an arc tube, a simmer discharge resistor is short-circuited by a switching unit to generate main discharge, whereby the main discharge current is suppressed from flowing into the inner wall of the arc tube, or a portion near there, thereby preventing turbidity and breakage of the arc tube.

Moreover, to shorten heating time, when a rise of light emission of a flash lamp is made steep so that the temperature of a substrate rises steeply, there is a problem on which deformation or cracks of the substrate occurs, due to heat strain generated by the difference in temperature of a bottom face and a surface of the substrate. In Japanese Patent Application Publication No. 2009-164201, the technology for avoiding such a problem is proposed. In the technology, it has been found that it is desirable to perform a processing in which the surface temperature of the substrate is not raised at a stretch to target temperature, but it is temporarily raised to second temperature lower than the target temperature, thereby holding that temperature for a short time, or the temperature thereof is raised while the temperature rise rate is controlled, and then it is raised to the target temperature. To realize the technology, a semiconductor switch 25 is connected in series to a flash lamp, and after the flash lamp is triggered, the semiconductor switch 25 is turned ON/OFF at least once. Then the semiconductor switch 25 is turned ON only once, so that the waveform of current, which flows into the flash lamp, is controlled.

However, in the technology described in Japanese Patent Application Publication No. 2009-164201, there is a problem that a desired lamp current waveform cannot be realized. In case where a period of low lamp current is set to a low level, the problem is attributed to a possibility that electric discharge stops and the light goes out when it becomes, within the period, less than the minimum current value, at which electric discharge can be maintained in the lamp, due to manufacturing tolerance and temperature conditions of a lamp, and/or fluctuation of timing of ON/OFF of the semiconductor switch 25.

To re-light the lamp when the light goes out, a considerable time delay for re-lighting the lamp is needed, since it is necessary to wait until whether the lamp goes out is detected so that a signal for activating the starting circuit (Ut) is outputted, whereby the starting circuit (Ut), which receives the signal, starts an operation to generate high voltage, and dielectric barrier discharge is produced in the electrical discharge space (Ds) of the lamp by the impressed high voltage, thereby causing the main discharge between the main electrodes (E1, E2). Moreover, there are variations in timing from when the high voltage is generated by the starting circuit (Ut) until electric discharge actually starts. Thus, they adversely affect a heating program in substrate processing.

Therefore, lamp current can be only reduced to a current value, in which a sufficient amplitude is available with respect to the minimum current value, so that design and setting of lamp current waveform are restricted.

SUMMARY

The present invention relates to a discharge lamp lighting apparatus including a pair of main electrodes for main discharge arranged to face each other in an electrical discharge space, and a discharge lamp is lighted by flash electric discharge, wherein a starting electrode is not in contact with the electrical discharge space, comprising a main capacitor that accumulates electric charges for producing electric discharge in the discharge lamp; a charge circuit for charging the electric charges in the main capacitor; a main switching element inserted in a middle of a path for discharging the electric charges charged in the main capacitor; a main gate driving circuit that controls and drives ON and OFF states of the switching element by receiving a main gate signal; a simmer current supply circuit that can pass simmer current through the discharge lamp; a starting circuit that impresses high voltage to the starting electrode by receiving a starting signal; and an electric discharge sequence control circuit that generates the main gate signal and the starting signal; wherein when lighting the discharge lamp the electric discharge sequence control circuit outputs the starting signal to generate a sequence that includes the main gate signal corresponding to an alternating repetition of the ON and Of states of the main switching element, wherein before outputting the starting signal the main gate signal changes to a stand-by state to corresponds to the ON state of the main switching element, and wherein control of the sequence starts when the starting signal is outputted.

Alternatively, in the discharge lamp lighting apparatus the control of the sequence may start in a state where the simmer current flows therethrough after the starting signal is outputted.

Further, in the discharge lamp lighting apparatus the electric discharge sequence control circuit may form the sequence that makes a period of the last ON state of the main switching element sufficiently long, so that the electric charges accumulated in the main capacitor are discharged current of the discharge lamp is interrupted.

Furthermore, the discharge lamp lighting apparatus may further comprising a lamp current detection unit for generating a lamp current detection signal by detecting current flowing through the discharge lamp, wherein the electric discharge sequence control circuit generates a sequence that maintains a period of the last ON state of the main switching element until the electric charges accumulated in the main capacitor are discharged so that the lamp current detection signal stops.

Also, a discharge lamp lighting apparatus including a pair of main electrodes for main discharge that is arranged to face each other in an electrical discharge space, and a discharge lamp lighted by flash electric discharge, wherein a starting electrode is not in contact with the electrical discharge space, may comprise a main capacitor that accumulates electric charges for producing electric discharge in the discharge lamp; a charge circuit for charging the electric charges in the main capacitor; a main switching element inserted in a middle of a path for discharging the electric charges charged in the main capacitor; a main gate driving circuit that controls and drives ON and OFF states of the switching element by receiving a main gate signal; a simmer current supply circuit that is activates by receiving a simmer control signal and that can pass simmer current through the discharge lamp; a starting circuit that impresses high voltage to the starting electrode by receiving a starting signal; and an electric discharge sequence control circuit that generates the main gate signal, the simmer control signal, and the starting signal, wherein when lighting the discharge lamp, the electric discharge sequence control circuit outputs the simmer control signal, which activates the simmer current supply circuit, and outputs the starting signal to generate a sequence of the main gate signal corresponding to an alternating repetition of the ON and Of states of the main switching element, and wherein before or after the end of the sequence the simmer control signal is stopped.

Further, the discharge lamp lighting apparatus according to any one of the prior arrangements may include a main gate sequence memory stores ON state continuation period information and OFF state continuation period information with respect to the main switching element, wherein the ON state continuation period information and the OFF state continuation period information are alternatively read out from the main gate sequence memory, and wherein the main gate signal is generated based on the period information alternatively read out from the main gate sequence memory.

Furthermore, the discharge lamp lighting apparatus according to any one of the prior arrangements may include a lamp current detection unit for generating a lamp current detection signal by detecting the current which flows into the discharge lamp; and a current target signal generation circuit that generates the lamp current target signal, which is a target waveform signal regarding a value of current flowing into the discharge lamp, wherein the electric discharge sequence control circuit compares the lamp current target signal with the lamp current detection signal and generates information of the ON state continuation period of the main switching element and information of the OFF state continuation period which are respectively realized in an alternating order, by pulse width modulation, so that the difference between the signals becomes small and the main gate signal, which alternatively repeats the ON state continuation period and the OFF state continuation period is generated.

BRIEF DESCRIPTION OF THE DRAWINGS

Other features and advantages will be apparent from the ensuing description, taken in conjunction with the accompanying drawings, in which.

DESCRIPTION

Figure 1:
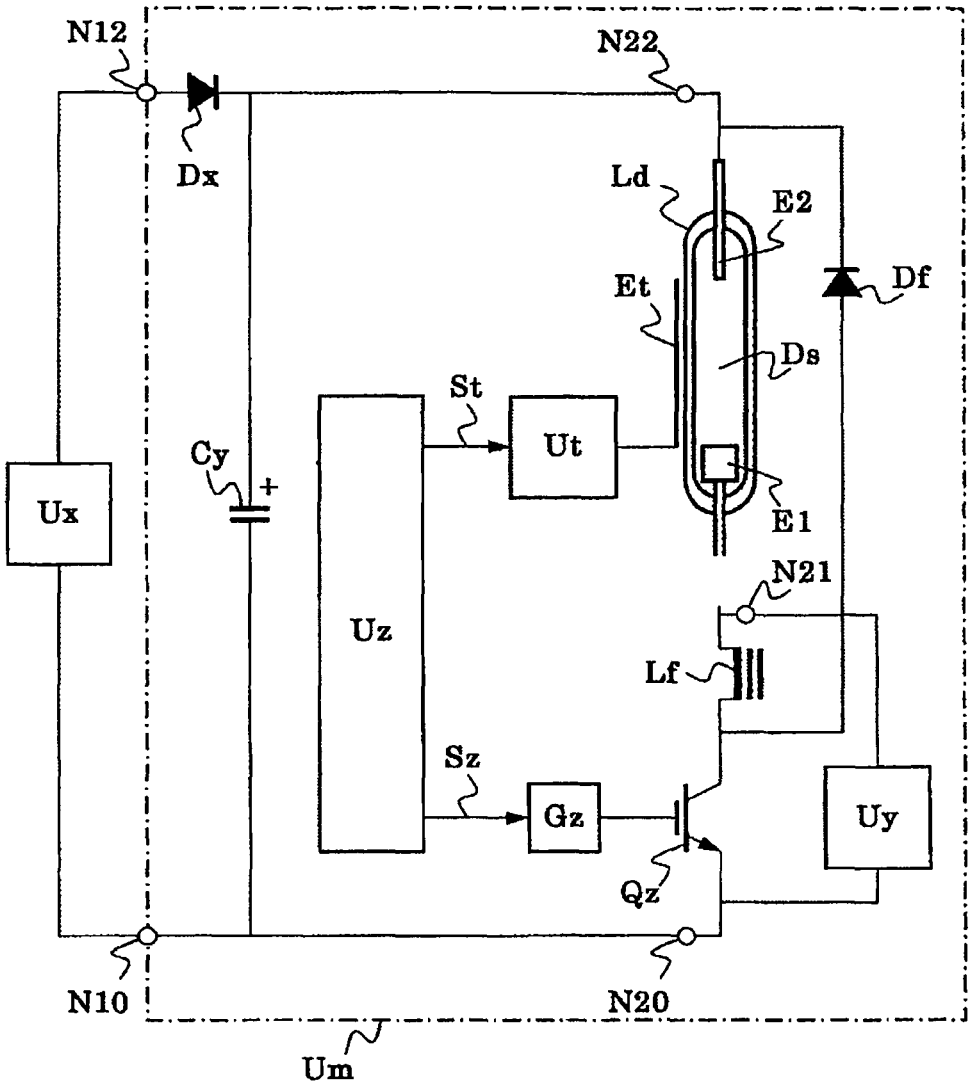
FIG. 1 is a simplified block diagram of a discharge lamp lighting apparatus according to an embodiment.

Thus, it is an object to offer a discharge lamp lighting apparatus, in which when lamp current is set to a low level, it is not necessary to set a margin that is too sufficient with respect to the minimum current value capable of maintaining electric discharge in the lamp, and flexibility of design and setting of the lamp current waveform can be enhanced.

A discharge lamp lighting apparatus according to a first embodiment includes a pair of main electrodes (E1, E2) for main discharge arranged to face each other in an electrical discharge space (Ds), and a discharge lamp (Ld) that is lighted by flash electric discharge, wherein a starting electrode (Et) is not in contact with the electrical discharge space (Ds), comprises a main capacitor (Cz) that accumulates electric charges for producing electric discharge in the discharge lamp (Ld), a charge circuit (Ux) for charging the electric charges in the main capacitor (Cz), a main switching element (Qz) inserted in the middle of a path for discharging the electric charges charged in the main capacitor (Cy), through the discharge lamp (Ld), a main gate driving circuit (Gz) that controls and drives ON and OFF states of the switching element (Qz) by receiving a main gate signal (Sz), a simmer current supply circuit (Uy) that can pass simmer current through the discharge lamp (Ld), a starting circuit (Ut) that impresses high voltage to the starting electrode (Et) by receiving a starting signal (St), and an electric discharge sequence control circuit (Uz) that generates the main gate signal (Sz) and the starting signal (St), wherein when lighting the discharge lamp (Ld), the electric discharge sequence control circuit (Uz) outputs the starting signal (St) to generate a sequence of the main gate signal (Sz) corresponding to an alternating repetition of the ON and Of states of the main switching element (Qz), and before the starting signal (St) is outputted, the main gate signal (Sz) is changed into a state corresponding to the ON state of the main switching element (Qz) so as to be on a stand-by state, and control of the sequence is started from time when the starting signal (St) is outputted.

A discharge lamp lighting apparatus according to a second embodiment includes a pair of main electrodes (E1, E2) for main discharge arranged to face each other in an electrical discharge space (Ds), and a discharge lamp (Ld) lighted by flash electric discharge, wherein a starting electrode (Et) is not in contact with the electrical discharge space (Ds), comprises a main capacitor (Cz), which accumulates electric charges for producing electric discharge in the discharge lamp (Ld), a charge circuit (Ux) for charging the electric charges in the main capacitor (Cy), a main switching element (Qz) inserted in the middle of a path for discharging the electric charges charged in the main capacitor (Cy), through the discharge lamp (Ld), a main gate driving circuit (Gz), which controls and drives ON and OFF states of the switching element (Qz) by receiving a main gate signal (Sz), a simmer current supply circuit (Uy), which can pass simmer current through the discharge lamp (Ld), a starting circuit (Ut), which impresses high voltage to the starting electrode (Et) by receiving a starting signal (St), and an electric discharge sequence control circuit (Uz), which generates the main gate signal (Sz) and the starting signal (St), wherein when the discharge lamp (Ld) is lighted, the electric discharge sequence control circuit (Uz) outputs the starting signal (St), so that a sequence of the main gate signal (Sz) corresponding to an alternating repetition of the ON and Of states of the main switching element (Qz) is generated, and before the starting signal (St) is outputted, the main gate signal (Sz) is changed into a state corresponding to the OFF state of the main switching element (Qz) to be in a stand-by state, and control of the sequence starts in a state where the simmer current flows therethrough after the starting signal (St) is outputted.

According to a third embodiment, in a discharge lamp lighting apparatus of the first and second embodiments, the electric discharge sequence control circuit (Uz) forms the sequence that makes a period of the last ON state of the main switching element (Qz) sufficiently long, so that the electric charges accumulated in the main capacitor (Cz) are discharged, thereby stopping current of the discharge lamp (Ld).

According to a forth embodiment, a discharge lamp lighting apparatus of the first and second embodiments further comprise a lamp current detection unit (Fi) for generating a lamp current detection signal (Sfi) by detecting current flowing through the discharge lamp (Ld), wherein the electric discharge sequence control circuit (Uz) generates a sequence which maintains a period of the last ON state of the main switching element (Qz) until the electric charges accumulated in the main capacitor (Cz) are discharged so that the lamp current detection signal (Sfi) stops.

A discharge lamp lighting apparatus according to a fifth embodiment includes a pair of main electrodes (E1, E2) for main discharge arranged to face each other in an electrical discharge space (Ds), and a discharge lamp (Ld) lighted by flash electric discharge, wherein a starting electrode (Et) is not in contact with the electrical discharge space (Ds), comprises a main capacitor (Cy), which accumulates electric charges for producing electric discharge in the discharge lamp (Ld), a charge circuit (Ux) for charging the electric charges in the main capacitor (Cy), a main switching element (Qz) inserted in the middle of a path for discharging the electric charges charged in the main capacitor (Cy), through the discharge lamp (Ld), a main gate driving circuit (Gz), which controls and drives ON and OFF states of the switching element (Qz) by receiving a main gate signal (Sz), a simmer current supply circuit (Uy), which is activated by receiving a simmer control signal (Sy), and which can pass simmer current through the discharge lamp (Ld) and a starting circuit (Ut), which impresses high voltage to the starting electrode (Et) by receiving a starting signal (St), and an electric discharge sequence control circuit (Uz) that generates the main gate signal (Sz), the simmer control signal (Sy) and the starting signal (St), wherein when the discharge lamp (Ld) is lighted, the electric discharge sequence control circuit (Uz) outputs the simmer control signal (Sy) so that the simmer current supply circuit (Uy) is activated, and outputs the starting signal (St), so that a sequence of the main gate signal (Sz) corresponding to an alternating repetition of the ON and Of states of the main switching element (Qz) is generated, and before or after the end of the sequence, the simmer control signal (Sy) is stopped.

In a discharge lamp lighting apparatus according to a sixth embodiment, the electric discharge sequence control circuit (Uz) of the first to fifth embodiments has a main gate sequence memory, in which ON state continuation period information T1', T2', . . . , Tn−1', and Tn' that stores respectively realized in that order, and OFF state continuation period information X1', X2', . . . , Xn−1', which is respectively realized in that order after each ON state, with respect to the main switching element (Qz), wherein the ON state continuation period information T1', T2', . . . , Tn−1' and Tn' and the OFF state continuation period information X1', X2', . . . , Xn−1' are alternatively read out from the main gate sequence memory in order to generate the main gate signal (Sz), which repeats the ON state continuation period and the OFF state continuation period by turns.

According to a seventh embodiment, a discharge lamp lighting apparatus of the first to fifth embodiments includes a lamp current detection unit (Fi) for generating a lamp current detection signal (Sfi), by detecting the current that flows into the discharge lamp (Ld), and a current target signal generation circuit (Ug) that generates the lamp current target signal (Sgi), which is a target waveform signal regarding a value of current flowing into the discharge lamp (Ld), wherein the electric discharge sequence control circuit (Uz) compares the lamp current target signal (Sgi) with the lamp current detection signal (Sfi) and generates information of the ON state continuation period (T1, T2, . . . , Tn−1, Tn) of the main switching element (Qz), which are respectively realized in order, and information of the OFF state continuation period (X1, X2, . . . , Xn−1) thereof, which is respectively realized in order after each ON state, by pulse width modulation, so that the difference between the signals may become small, so as to generate the main gate signal (Sz) that alternately repeats the ON state continuation period and the OFF state continuation period.

Accordingly, since it is not necessary to form a margin that is too sufficient with respect to the minimum current value capable of maintaining electric discharge in the lamp when lamp current is set to a low level, it is possible to offer a discharge lamp lighting apparatus design flexibility and the setting of lamp current waveform is enhanced.

Figure 2:
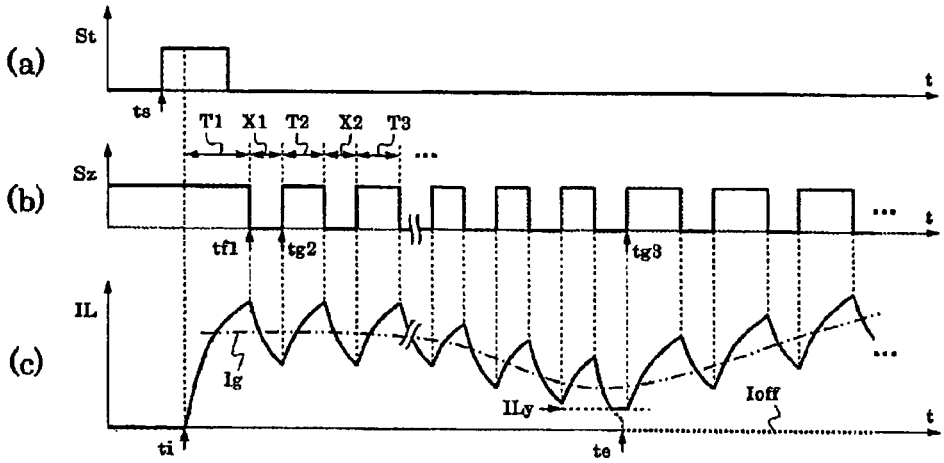
FIG. 2 is a simplified timing diagram of a discharge lamp lighting apparatus according to an embodiment.

Description of one of embodiments of the discharge lamp lighting apparatus will be given below, referring to FIGS. 1 and 2. FIG. 1 is a simplified block diagram of a discharge lamp lighting apparatus according to an embodiment. FIG. 2 is a simplified timing diagram of a discharge lamp lighting apparatus according to an embodiment. In FIG. 2, (a) shows a starting signal (St), (b) shows a main gate signal (Sz), and (c) shows the lamp current (IL), flows into a discharge lamp (Ld).

Both terminals of a main capacitor (Cy), which accumulates electric charges to make the discharge lamp (Ld) emit light, are connected to a charge circuit (Ux) for charging the electric charges in the capacitor (Cz). In addition, when the main capacitor (Cz) completes the charging of the capacitor (Cz) to raise the voltage to a predetermined level, the charge circuit (Ux) stops its operation, so that the electric charges accumulated in the main capacitor (Cz) are discharged and flash lighting automatically stops. In such case, it is desirable to provide a diode (Dx) on an input side of the charging current of each flash lamp module (Um), so that the current is prevented from flowing backwards, that is, towards the charge circuit charging (Ux) from the main capacitor (Cz), and so that the plurality of flash lamp modules (Um), each of which is made up of the main capacitor (Cz) and a downstream part thereof, can be charged by one charge circuit (Ux). In this case, nodes (N10, N12) of each flash lamp module (Um) are connected to the charge circuit (Ux).

Moreover, the both terminals of the main capacitor (Cz) are connected to a circuit, in which the discharge lamp (Ld) is in series connected with a main switch element (Qz), which uses an IGBT. The main switching element (Qz) is controlled by a main gate signal (Sz) to be in an ON state or an OFF state, through a main gate driving circuit (Gz). A starting circuit (Ut), which generates high voltage in response to a starting signal (St), is connected to a starting electrode (Et), which is provided outside a bulb of the discharge lamp (Ld) so as not to contact an electrical discharge space (Ds). The main gate signal (Sz) and the starting signal (St) are generated by an electric discharge sequence control circuit (Uz). In addition, FIG. 2 shows a case where when the main gate signal (Sz) is at a high level the main switching element (Qz) is in an ON state, and when the main gate signal (Sz) is at a low level the main switching elements (Qz) is in an OFF state. Moreover, in FIG. 2, when the starting signal (St) is at a high level, the starting circuit (Ut) is activated by the starting signal (St).

In the electric discharge sequence control circuit (Uz), when the starting signal (St) is activated at time (ts) in a state where the main gate signal (Sz) is outputted so that the main switching element (Qz) is in an ON state, the starting circuit (Ut) generates the high voltage, so as to impress high voltage to the starting electrode (Et). The impressed high voltage causes dielectric barrier discharge in the electrical discharge space (Ds) through a bulb wall of the discharge lamp (Ld). Since the main switching element (Qz) is in the ON state, the charge voltage of the main capacitor (Cz) is impressed, as it is, between the main electrodes (E1, E2) of the discharge lamp (Ld), the main discharge is induced by the plasma produced by dielectric barrier discharge so that main discharge starts between the main electrodes (E1, E2) at time (ti).

To control the rising speed of the generated main discharge current, an inductor (Lf) is connected in series to the discharge lamp (Ld), and while magnetic energy is accumulated in the inductor (Lf), the lamp current (IL) slowly increases, as shown in FIG. 2. When the main gate signal (Sz) is changed to a low level so that the main switching element (Qz) is changed into an OFF state at time (tf1) while lamp current increases, the current supplied to the lamp from the main capacitor (Cz) is interrupted. However, since magnetic energy is accumulated in the inductor (Lf), the high voltage in a direction in which current continues to flow, is generated in the inductor (Lf), when the current path is suddenly disconnected. Therefore, a diode (Df) is in parallel connected to a series circuit made up of the inductor (Lf) and the discharge lamp (Ld). When the main switching element (Qz) is in an OFF state, due to an operation of this diode, a closed loop, which is made up of the inductor (Lf), the discharge lamp (Ld), and the diode (Df), is formed, and while the lamp current flows back in this closed loop, the magnetic energy accumulated in the inductor (Lf) is released, so that, as shown in FIG. 2, the lamp current (IL) slowly decreases.

When the main gate signal (Sz) is changed into a high level so that the main switching element (Qz) is changed into an ON state at the time (tg2) while the lamp current is going down, the current supply to the lamp from the main capacitor (Cz) is restarted, so that the lamp current (IL) slowly goes up. Thus, when a sequence of the main gate signal (Sz) is set up so that the ratio (or duty cycle ratio) of the ON state continuation period (T1, T2, T3, . . . ) of the main switching element (Qz) to the OFF state continuation period (X1, X2, . . . ) becomes a suitable value, the lamp current (IL) varies (increases and decreases) with respect to a predicted lamp current target waveform (Ig), and a saw-tooth like curve forms, as a dot-dash line of (c) in FIG. 2 shows.

In the discharge lamp lighting apparatus of FIG. 1, even if the main switching element (Qz) is in an OFF state, the simmer current supply circuit (Uy) is provided in parallel to the main switching element (Qz) so that simmer current can be passed therethrough. The simmer current supply circuit (Uy) is made up of, for example, a resistor(s). A path of current, which flows into a minus side terminal of the main capacitor (Cz) from a plus side terminal of the main capacitor (Cz) through the discharge lamp (Ld) connected to the plus side terminal and the simmer current supply circuit (Uy), is formed. Therefore, even when the main switching element (Qz) is in the OFF state, it is possible to pass imperceptible current, i.e., simmer current, through the discharge lamp (Ld) from the main capacitor (Cz). Therefore, for example, in a period when the lamp current target waveform (Ig) is set to a low level as shown in FIG. 2 (*c*), it is possible to prevent the light from going out when the electric discharge stops, because when it becomes less than the minimum current value the electric discharge can be maintained in the lamp within that period, due to manufacturing tolerance and temperature conditions of the lamp, and/or fluctuation of ON/OFF timing of the semiconductor switch 25.

In case where the simmer current supply circuit (Uy) is not provided, when it becomes less than the minimum current value, at which electric discharge can be maintained in the lamp, electric discharge stops so that the light goes out at the time (te), as in a current waveform (Ioff) shown in FIG. 2(*c*). However, if the simmer current supply circuit (Uy) is provided, the current supply capacity, that is, the simmer current (ILy), which is determined by a value of a resistor (if it is a resistor), the discharge lamp, and the voltage of the main capacitor (Cz) at that time, is at least secured. Thus, it is possible to maintain electric discharge. And when the main gate signal (Sz) is changed to a high level so that the main switching element (Qz) is changed to an ON state at time (tg3), it returns to the main discharge from the simmer electric discharge, so that lamp current (IL) slowly increases.

Here, a point, on which attention should be focused, is that in the middle of the sequence of the main gate signal (Sz), when a phenomenon of it becoming less than the minimum current value occurs and at which electric discharge can be maintained in the lamp does not occur, the starting circuit (Ut) of this discharge lamp lighting apparatus generates a high voltage so that flash electric discharge light emission starts, and when the lamp current of lamp current target waveform (Ig) approximately flows therethrough and the electric charges accumulated in the main capacitor (Cz) are exhausted so that voltage, which is impressed to the lamp from the main capacitor, becomes less than the minimum voltage value, at which electric discharge can be maintained, the current, which automatically flows into the lamp, becomes less than the minimum current value, at which electric discharge can be maintained, so that electric discharge stops and the light goes out. That is, in such an operation, simmer current does not flow therethrough. That is, if the described discharge lamp lighting apparatus is used, it turns out that the knowledge regarding the substrate heating processing, which has been accumulated from the past, can be used as it is, in such a normal operation mode.

Furthermore, the described discharge lamp lighting apparatus is effective not only when the light goes out unintentionally as described above, but also when substantial non-lighting period is, on purpose, provided for a short time. This feature add design flexibility and the lamp current waveform setup. If induced current, which flows therethrough by an operation of the inductor (Lf) inserted in series in the discharge lamp (Ld), becomes less than the minimum current value, at which electric discharge can be maintained, and if the simmer current supply circuit (Uy) is not provided, when a period of the main gate signal (Sz) corresponding to an OFF state of the main switching element (Qz), which has a continuation period longer than a period required up to a time point at which electric discharge stops, from transition to the OFF state of the main switching element (Qz), that is, an induction relaxation time excess OFF period, is included one or more times within the sequence of the main gate signal (Sz), which is generated by the electric discharge sequence control circuit (Uz), as to the electric discharge in the discharge lamp (Ld), the main discharge certainly stops in the induction relaxation time excess OFF period, so as to turn into the simmer discharge. And when the induction relaxation time excess OFF period is expired and the main discharge is restarted, it is not necessary to use the starting circuit (Ut). Therefore, as mentioned above, it is possible to prevent the problem that there are variations in timing from when the high voltage is generated by the starting circuit (Ut) to when electric discharge actually starts. In addition, in this case, although in fact there is simmer discharge in the substantial non-lighting period, if the simmer discharge is made weak, that period can be made substantially equivalent to the non-lighting period, from a viewpoint of substrate heating.

In addition, as shown in FIG. 2, the time (ts), at which the starting signal (St) is activated, is not agreement with the time (ti), at which the main discharge starts. This is because there is a considerable time delay before dielectric barrier discharge occurs in the electrical discharge space (Ds) of the lamp due to supply of high voltage, which is generated when the starting circuit (Ut) activated by the starting signal (St) starts its operation, so that the main discharge is induced between the main electrodes (E1, E2). Moreover, there are variations in timing from when the high voltage is generated by the starting circuit (Ut) to when the electric discharge actually starts.

Therefore, the discharge lamp lighting apparatus according to this embodiment has a lamp current detection unit (Fi) for generating a lamp current detection signal (Sfi) by detecting the current, which flows into the discharge lamp (Ld), wherein the apparatus is desirably configured so that the time (ti), at which the main discharge starts based on the lamp current detection signal (Sfi), is detected, whereby the sequence of the main gate signal (Sz) is started from that time point. In addition, although the terms "simmer discharge" and "simmer current", which are used with respect to the described discharge lamp lighting apparatus, are not semantically exactly the same as the terms, "simmer current" and "simmer discharge" in the lighting technology of a general flash lamp, they are used for descriptive purposes, since they are conceptionally similar to each other.

Figure 3:
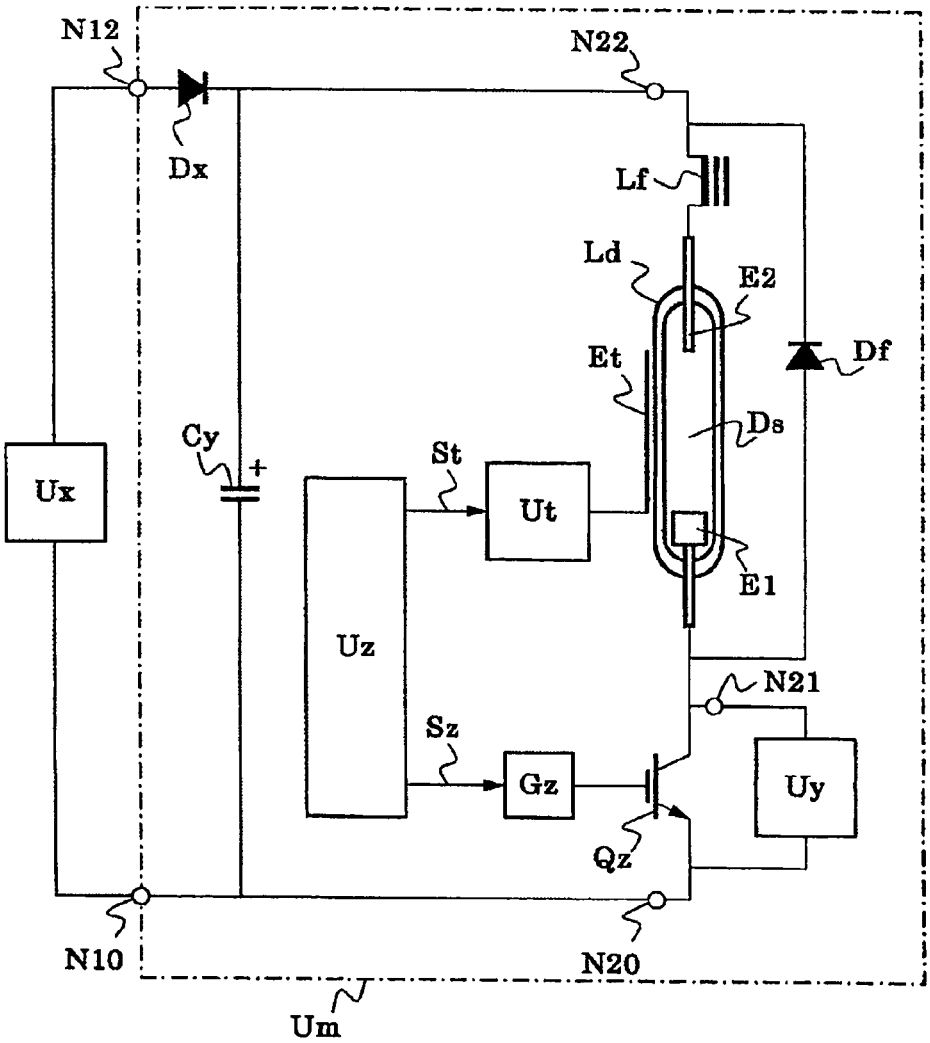
FIG. 3 is a simplified block diagram of a discharge lamp lighting apparatus according to an embodiment.

In addition, a way of connecting the discharge lamp (Ld) with the inductor (Lf), the main switching element (Qz), and the simmer current supply circuit (Uy), is not limited to that shown in FIG. 1. For example, FIG. 3 is a simplified block diagram of a discharge lamp lighting apparatus according to an embodiment. As in the connecting method shown in FIG. 3, from the view point of a circuit design or selection of parts, a suitable connecting method may be chosen. That is, for example, the terminal side of the main capacitor (Cz) is connected to the inductor (Lf) and the discharge lamp (Ld) is connected to the main switching element (Qz) side, or the simmer current supply circuit (Uy) is in parallel connected to the main switching element (Qz).

Figure 4:
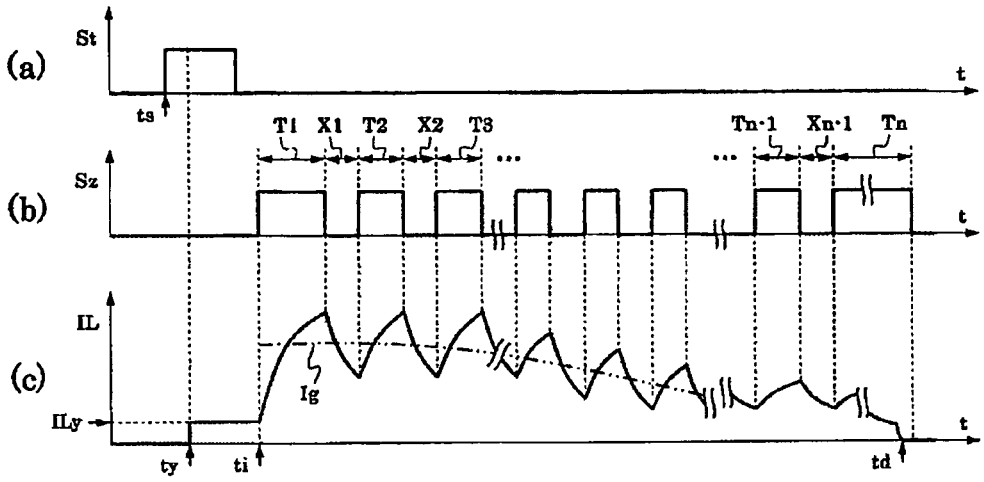
FIG. 4 is a simplified timing diagram of a discharge lamp lighting apparatus according to an embodiment.

Description of one of embodiments of the discharge lamp lighting apparatus will be given below, referring to FIG. 4. FIG. 4 is a simplified timing diagram of a discharge lamp lighting apparatus according to an embodiment. Similarly to FIG. 2, in FIG. 4, (a) shows a starting signal (St), (b) shows a main gate signal (Sz), and (c) shows lamp current (IL) that flows into a discharge lamp (Ld).

The embodiment shown in FIG. 4 is different from that of FIG. 2, in that electric discharge sequence control circuit (Uz) waits in a state where the main gate signal (Sz) is outputted so that a main switching element (Qz) is in an OFF state, and activates the starting signal (St) at time (ts). A starting circuit (Ut) generates high voltage, so that the high voltage is impressed to a starting electrode (Et), whereby dielectric barrier discharge occurs in an electrical discharge space (Ds). Since the charge voltage of a main capacitor (Cz) is impressed between the main electrodes (E1, E2) of the discharge lamp (Ld), main discharge is induced by plasma produced by dielectric barrier discharge, so that the main discharge starts between the main electrodes (E1, E2) at time (ty). Since the main switching element (Qz) is in an OFF state, the current, which flows into the lamp, becomes simmer current (ILy), which flows through a simmer current supply circuit (Uy).

In the state where the simmer current (ILy) flows through the electric discharge sequence control circuit (Uz), the main gate signal (Sz) starts being outputted so that the main switching element (Qz) is in an ON state at time (ti). Since the simmer current flows therethrough by this time, main discharge starts in the discharge lamp (Ld), without a considerable time delay. Thus, when a sequence of the main gate signal (Sz) is set up so that the ratio (or duty cycle ratio) of the ON state continuation period (T1, T2, T3, . . . ) of the main switching element (Qz) to the OFF state continuation period (X1, X2, . . . ) becomes a suitable value, similarly to that of FIG. 2, predicted lamp current target waveform (Ig) can be approximately realized. In such a case, similarly, in a period when the lamp current target waveform (Ig) is set to a low level, it is possible to prevent a problem that electric discharge stops and the lamp goes out within that period. Thus, when it becomes less than the minimum current value, the electric discharge can be maintained in the lamp, due to manufacturing tolerance and temperature conditions of the lamp, and/or fluctuation of ON/OFF timing of the semiconductor switch 25.

A flash lamp light source using simmer discharge may be used, for example, for a toner image fixing of a high-speed toner printer, a stroboscope, or the like. In the discharge lamp lighting apparatus used in a heating apparatus, annealing apparatus, or a system or for manufacturing processes of a semiconductor and a thin film transistor, frequency of main discharge, i.e., flash light emission, is lower than that the cases of the image fixing of a high-speed toner printer and the stroboscope. Therefore, in such a situation, there is no point to continue simmer discharge for a long time in a period between main discharge and the next main discharge. Furthermore, the continuation of the simmer discharge is not desirable in view of the life span of the lamp, depending on the material and structure of the main electrode (E1, E2) of the lamp.

Therefore, it is advantageous that the simmer discharge is generated for only a short period immediately before the main discharge starts, as described above. Or only when electric discharge is maintained to prevent light from going out where electric discharge is about to stop. Or only when a short time substantial-non-lighting period is intentionally provided as one of design flexibilities and lamp current waveform setups. Simply, such limitation to the period of the simmer discharge can be realized by the sequence of the main gate signal (Sz), in which the period of the last ON state of the main switching element (Qz) is made sufficiently long. Thus, the electric charges accumulated in the main capacitor (Cz) are discharged to stop the current of the discharge lamp (Ld). In FIG. 4, the current of the discharge lamp (Ld) is interrupted at time (td) due to an ON state continuation period (Tn) of the last main gate signal (Sz), which is sufficiently long.

Furthermore, a lamp current detection unit (Fi) for generating a lamp current detection signal (Sfi) by detecting the current, which flows into the discharge lamp (Ld), is provided to certainly perform an operation, and this can be realized by configuring the sequence of the main gate signal (Sz) so that the period of the last ON state of the main switching element (Qz) is maintained until the electric charges accumulated in the main capacitor (Cz) are discharged, whereby the lamp current detection signal (Sfi) stops.

Figure 5:
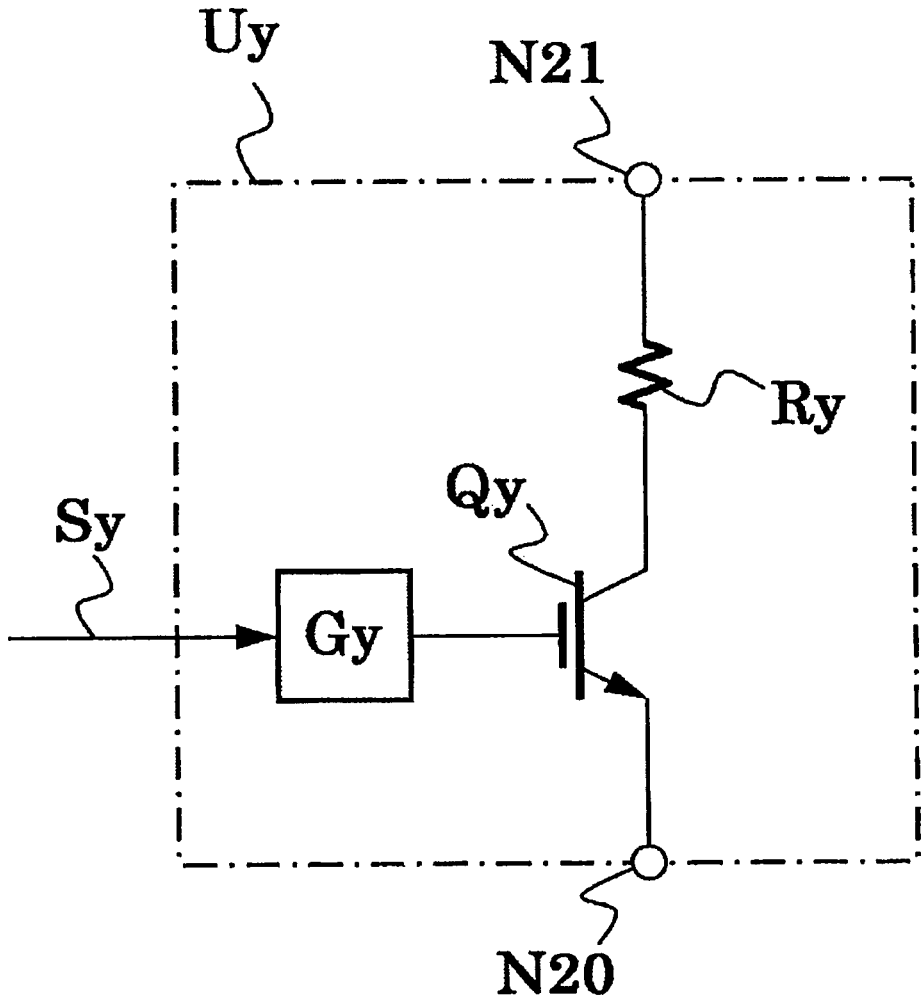
FIG. 5 is a schematic diagram of the structure of part of a discharge lamp lighting apparatus according to an embodiment.

As described above, the limitation to the period of the simmer discharge can be actively realized if the simmer current supply circuit (Uy) is activated when receiving a simmer control signal (Sy), but not waiting until the electric charges accumulated in the main capacitor (Cz) are exhausted. Description of structure of the simmer current supply circuit (Uy) will be described referring to FIG. 5. FIG. 5 is a schematic diagram of the structure of part of a discharge lamp lighting apparatus. In this circuit shown in this figure, nodes (N20, N21) are arranged to correspond to the structure elements shown in FIG. 1 or 3, wherein numerical references are the same as those assigned to the structure elements shown in FIG. 1 or 3.

A switching element (Qy), which uses IGBT, is inserted in series to a resistor (Ry), which is connected in parallel to the main switching element (Qz), so that simmer current can be passed therethrough, even if the main switching element (Qz) is in an OFF state, whereby it is possible interrupt the simmer current. The switching element (Qy) is controlled based on the simmer control signal (Sy) to be in an ON state or an OFF state, through a gate driving circuit (Gy), and when the switching element (Qy) is in an ON state, the simmer current supply circuit (Uy) is in an activated state. The electric discharge sequence control circuit (Uz) activates the simmer control signal (Sy), and interrupts the simmer control signal (Sy) just before or immediately after the end of the sequence of the main gate signal (Sz). In addition, the simmer current of two or more flash lamp modules (Urn) can be controlled by a set of one switching element (Qy) and the gate driving circuit (Gy). In that case, the resistor (Ry) is provided for each flash lamp module (Ur).

Since a source of energy supply of a simmer current is the electric charges accumulated in the main capacitor (Cz) in the case of the simmer current supply circuit (Uy) of FIG. 5, voltage of the main capacitor (Cz) goes on decreasing after main discharge starts. Therefore, there is a drawback in that the capability to prevent electric discharge from stopping is strong immediately. But after the main discharge starts the capability grows weaker as time progresses.

Figure 6:
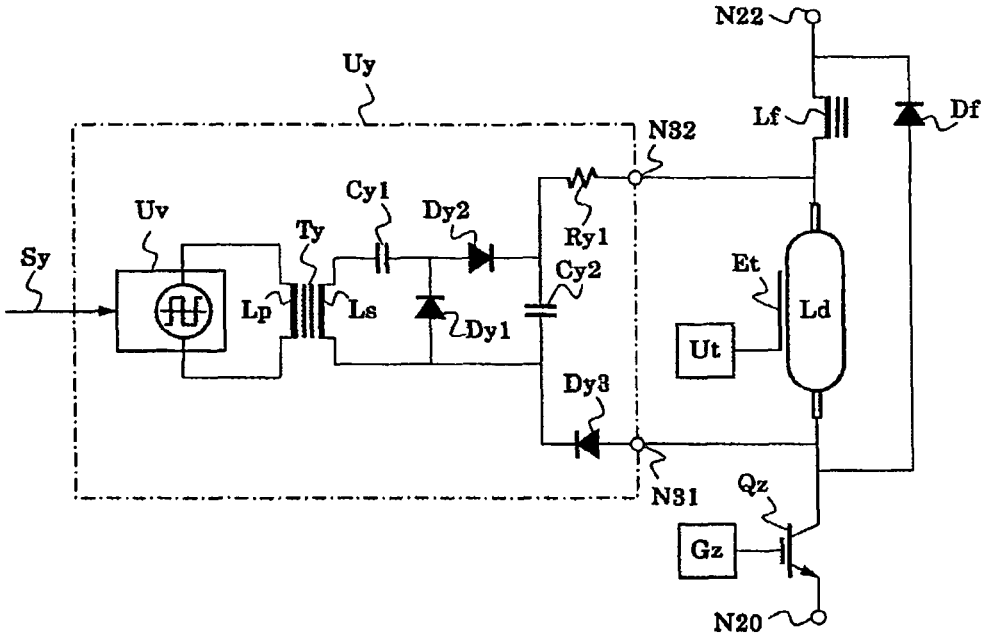
FIG. 6 is a schematic diagram of the structure of part of a discharge lamp lighting apparatus according to an embodiment.

Here, description of the structure of the simmer current supply circuit (Uy) which avoids this drawback will be given below, referring to FIG. 6. FIG. 6 is a schematic diagram of the structure of part of a discharge lamp lighting apparatus according to an embodiment. In the simmer current supply circuit (Uy) shown in this figure, output nodes (N31, N32) are connected to the main electrodes (E1, E2) of the discharge lamp (Ld). In addition, although an arrangement of the discharge lamp (Ld), the main switching element (Qz), an inductor (Lf), and a diode (Df) corresponds to that shown in FIG. 1, it is not limited so that the simmer current supply circuit (Uy) of this figure can be applied to the structure shown in FIG. 3 or a discharge lamp lighting apparatus having a different structure. An inverter (Uv) for driving a primary side winding (Lp) of a boosting transformer (Ty), is formed by, for example, a circuit, such as a full bridge or a half bridge, wherein activation and deactivation of the inverter (Uv) is performed by the simmer control signal (Sy). A capacitor (Cy1) is in series connected to a secondary side winding (Ls) of the boosting transformer (Ty), and a diode (Dy1) and a series circuit made up of a diode (Dy2) and a capacitor (Cy2), are in parallel connected to the secondary side winding (Ls), whereby voltage, which is twice quick peak voltage, is generated in the capacitor (Cy2). That is, the so-called voltage doubler rectifier circuit is formed. If the main discharge occurs, output voltage of this double-voltage rectifying circuit is impressed to the discharge lamp (Ld) through the diode (Dy3) for separating this double-voltage rectifying circuit from the lamp and a resistor (Ry1) for passing the stable simmer current therethrough, thereby passing the simmer current through the discharge lamp (Ld). The electric discharge sequence control circuit (Uz) activates a simmer control signal (Sy), activates a starting signal (St), and outputs the main gate signal (Sz), so that main discharge may be started, and the simmer discharge can be stopped by deactivating the simmer control signal (Sy) just before or immediately after the end of the sequence of the main gate signal (Sz), and stopping an operation of the inverter (Uv). And in the simmer current supply circuit (Uy) shown in the figure, it turns out that since an operation of the inverter (Uv) is controlled independently of the voltage of a main capacitor (Cz), it is possible to realize the discharge lamp lighting apparatus capable of avoiding the above drawback.

In addition, simmer current can be supplied to lamps of two or more flash lamp modules (Um) by one double-voltage rectifying circuit. In that case, the diode (Dy3) and the resistor (Ry1) are provided for each flash lamp module (Um).

Although in the example described above, the double-voltage rectifying circuit is formed on the secondary side of the transformer, two or more of such structures can be connected to each other in a multi-stage fashion. Thus, a Cockcroft-Walton circuit to carry out multiple rectifications, or a diode bridge that does not carry out double voltage rectification can be formed and used. Thus, in view of circuit design, or selection of parts, it is possible to use a suitable circuit.

To approximately realize a lamp current target waveform (Ig) that is shown in FIG. 2, the sequence of the main gate signal (Sz), which is set up so that the ratio (or duty cycle ratio) of the ON state continuation period (T1, T2, T3, . . . ) of the main switching element (Qz) to the OFF state continuation period (X1, X2, . . . ) becomes a suitable value, is described above; however, to concretely form such a sequence of the main gate signal (Sz), a main gate sequence memory is provided in the electric discharge sequence control circuit (Uz), so as to store, in advance, ON state continuation period information T1', T2', . . . , Tn−1', and Tn' of the main switching element (Qz), and OFF state continuation period information X1', X2', . . . , Xn−1'. Thus, when the lamp is lighted, such information can be alternative read out in order from the main gate sequence memory to generate the main gate signal (Sz). It is good to memorize, for example, a count upper limit of a high-low control timer counter of the main gate signal (Sz), which increments a count value every predetermined period, as the ON state and OFF state continuation period information memorized in the main gate sequence memory.

The electric discharge sequence control circuit (Uz) loads an ON state continuation period count upper limit Ti' read from the main gate sequence memory to a register, resets the timer counter to zero, sets the main gate signal (Sz) to a high level, and then increments a count value of the timer counter every predetermined period. When it detects that the count value is in agreement with the ON state continuation period count upper limit Ti', the electric discharge sequence control circuit (Uz) sets the main gate signal (Sz) to a low level, loads an OFF state continuation count upper limit Xi' read from the main gate sequence memory to the register, resets the timer counter to zero, and increments the count value of the timer counter every predetermined period. And when it detects that the count value is in agreement with the ON state continuation period count upper limit Xi', the electric discharge sequence control circuit (Uz) returns to similar processing related to the next ON state continuation period count upper limit Ti+1'. Since the electric discharge sequence control circuit (Uz) is configured to perform such a processing loop, from a first ON state continuation period count upper limit T1 to the last ON state continuation period count upper limit Tn, it is possible to generate of the main gate signal (Sz).

In addition, the concrete ON state and OFF state continuation period information, which is stored in the main gate sequence memory, may be determined through a trial and error process by observing actual lamp current waveform, so that it may be generated to vibrate towards upper and lower sides of lamp current target waveform (Ig).

Figure 7:
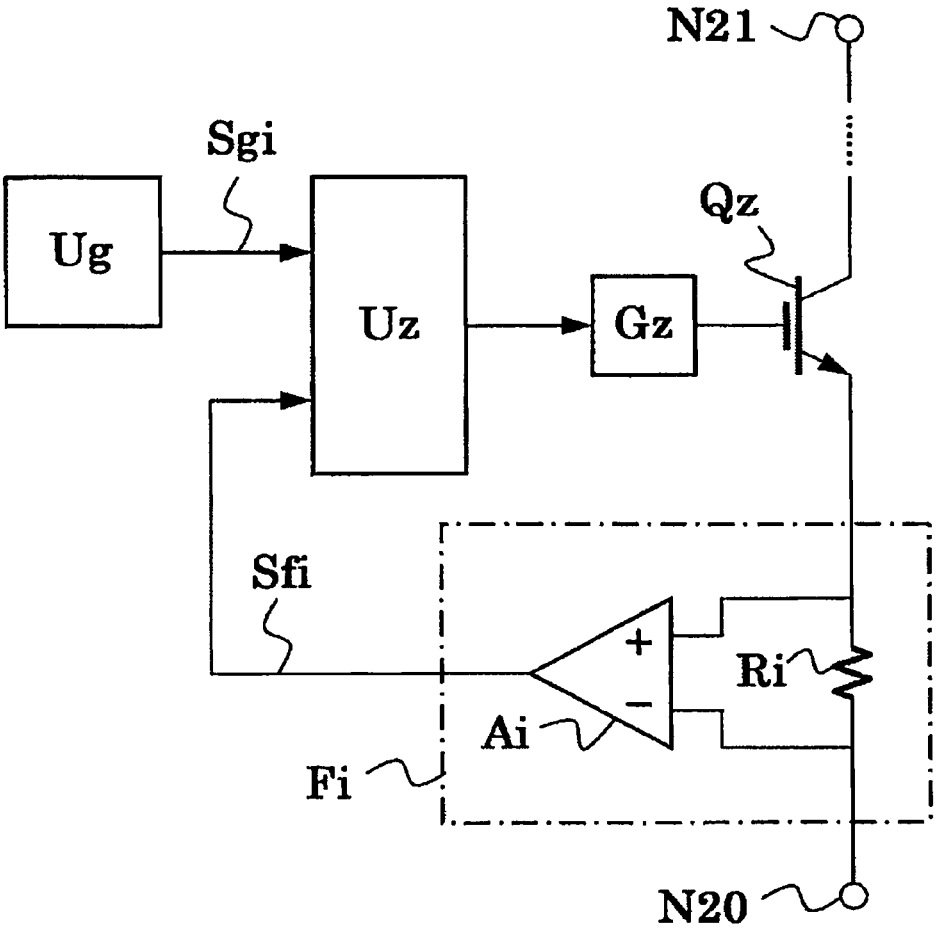
FIG. 7 is a schematic diagram of the structure of part of a discharge lamp lighting apparatus according to an embodiment.

There is a drawback of the influence of the lamp characteristic variation, the manufacturing tolerance of charge voltage of the charge circuit (Ux), and the like in the case where the information stored in the main gate sequence memory is fixed. Description of the structure of the simmer current supply circuit (Uy), which generates a sequence of the main gate signal (Sz) by measuring lump current in real time, and performing feedback control, will be given below, referring to FIG. 7. FIG. 7 is a schematic diagram of the structure of part of a discharge lamp lighting apparatus according to an embodiment. In this circuit shown in this figure, nodes (N20, N21) are arranged so as to correspond to those of the structure elements shown in FIG. 1 or 3, wherein the numerical references are the same as those assigned to the structure elements shown in FIG. 1 or 3.

A lamp current detection signal (Sfi) is generated by a lamp current detection unit (Fi), which is formed by a current detection element, such as a shunt resistor (Ri) and an operation amplifier (Ai), which are provided in a path of current flowing through the discharge lamp (Ld). Moreover, a current target signal generation circuit (Ug) generates a lamp current target signal (Sgi), which is a target waveform signal regarding a value of current flowing through the discharge lamp (Ld). The electric discharge sequence control circuit (Uz) compares the lamp current target signal (Sgi) with the lamp current detection signal (Sfi), and generates the main gate signal (Sz) by determining, in a feedback manner, an ON state continuation period (T1, T2, . . . , Tn−1, Tn) of the main switch element (Qz) and an OFF state continuation period (X1, X2, . . . , Xn−1), by pulse width modulation, so that the difference between the signals may become small. In addition, although a start timing signal of the sequence of the main gate signal (Sz) is required in order that the current target signal generation circuit (Ug) generates serially the lamp current target signal (Sgi), it is omitted in this figure.

The circuit configurations in the specification explains the operations, functions, and actions of the discharge lamp lighting apparatus. Therefore, it is premised that determinations of the details of the circuit configurations or the actions described above, for example, determinations of the polarity of signals, or originality and creativity, such as selections, additions, or omissions of concrete circuit elements, convenience of procurements of elements, or changes based on economic reasons, are carried out at the time of the design of actual apparatus and are contemplated by this specification.

In the structure of a discharge lamp lighting apparatus, it is not necessary to separately and independently provide respective functional blocks of the electric discharge sequence control circuit (Uz) and circumference circuits, that is, the main gate sequence memory, the current target signal generation circuit (Ug), the timer counter etc. For example, some of these functional blocks may be realized by software-based functions within a microprocessor or a digital signal processor. In such a case, for example, signals, such as the lamp current detection signal (Sfi), the lamp current target signal (Sgi), and a count value of the timer shop counter, may be realized as a value or a variable of a digital signal in a microprocessor or a digital signal processor. That is, an analog-voltage signal or an analog current signal are not required. Such structure is also one of the embodiments of the present invention.

In addition, improvement of functions and performance can be realized within freedom of design of a discharge lamp lighting apparatus. For example, the ON state continuation information T1', T2, . . . , Tn−1', Tn' or the OFF state continuation information X1', X2', . . . , Xn−1', etc. is kept in a non-volatile memory, such as FLASH memory, a main body apparatus that has a communication unit with the discharge lamp lighting apparatus, or the lamp current detection unit (Fi) realized by using a current probe in which a magnetic unit is used.

It is premised that mechanism for especially protecting circuit elements, that is, switching elements such as IGBT from breakage factors, for example, an overvoltage, and overcurrent or overheating, or mechanism for reducing a radiation noise or a conduction noise, generated due to an operation of the circuit element of the power supply apparatus or for preventing the generated noise from releasing to the outside, for example, a snubber circuit, and a varistor, a clamp diode, a current restriction circuit (including a pulse by pulse system), a noise filter choke coil of a common mode, or normal mode, or a noise filter capacitor, is added to each part of the circuit configuration shown in the embodiments if needed. The structure of the described discharge lamp lighting apparatus is not limited to a circuit described in this specification.

The present invention can be used in a heating apparatus, and annealing apparatus, or the like, or any system or manufacturing process for a semiconductor and a thin film transistor.

The preceding description has been presented only to illustrate and describe exemplary embodiments of the present discharge lamp lighting apparatus. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A discharge lamp lighting apparatus to light a discharge lamp by flash electric discharge, the discharge lamp includes a pair of main electrodes arranged to face each other in an electrical discharge space and a starting electrode that is not in contact with the electrical discharge space, comprising:

a main capacitor that accumulates electric charges for producing electric discharge in the discharge lamp;

a charge circuit that charges the electric charges in the main capacitor;

a main switching element inserted in a path between the main capacitor and the discharge lamp;

an electric discharge sequence control circuit that generates a main gate signal and a starting signal;

a main gate driving circuit that drives ON and OFF states of the switching element by receiving a main gate signal; and a starting circuit that impresses high voltage to the starting electrode by receiving a starting signal; wherein the sequence control circuit outputs the starting signal to the starting circuit while the main gate signal is supplied to the main switching element to keep the main switching element as a stand-by ON state; and, the sequence control circuit outputs a sequence of the main gate signal corresponding to an alternating repetition of ON and OFF states of the main switching element.

2. The discharge lamp lighting apparatus according to claim 1, wherein the electric discharge sequence control circuit forms the sequence that makes a period of the last ON state of the main switching element sufficiently long, so that the electric charges accumulated in the main capacitor are discharged current of the discharge lamp is interrupted.

3. The discharge lamp lighting apparatus according to claim 1, further comprising:

a lamp current detection unit that generates a lamp current detection signal by detecting current flowing through the discharge lamp, wherein the electric discharge sequence control circuit generates the sequence that maintains a period of the last ON state of the main switching element until the electric charges accumulated in the main capacitor are discharged so that the lamp current detection signal stops.

4. A discharge lamp lighting apparatus to light a discharge lamp by flash electric discharge, the discharge lamp includes a pair of main electrodes arranged to face each other in an electrical discharge space and a starting electrode that is not in contact with the electrical discharge space, comprising:

a main capacitor that accumulates electric charges for producing electric discharge in the discharge lamp;

a charge circuit that charges the electric charges in the main capacitor;

a main switching element inserted in a path between the main capacitor and the discharge lamp;

an electric discharge sequence control circuit that generates a main gate signal and a starting signal;

a main gate driving circuit that drives ON and OFF states of the switching element by receiving a main gate signal;

a starting circuit that impresses high voltage to the starting electrode by receiving a starting signal; and a simmer current supply circuit supplies a simmer current to the discharge lamp; wherein the electric discharge sequence control circuit outputs the starting signal to the starting circuit while the main gate signal is supplied to the main switching element to keep the main switching element as a stand-by OFF state;

the simmer current supply circuit supplies the simmer current; and the electric discharge sequence control circuit outputs a sequence of the main gate signal corresponding to an alternating repetition of ON and OFF states of the main switching element.

5. A discharge lamp lighting apparatus to light a discharge lamp by flash electric discharge, the discharge lamp includes a pair of main electrodes arranged to face each other in an electrical discharge space and a starting electrode that is not in contact with the electrical discharge space, comprising:

a main capacitor that accumulates electric charges for producing electric discharge in the discharge lamp;

a charge circuit that charges the electric charges in the main capacitor;

a main switching element inserted in a path between the main capacitor and the discharge lamp;

an electric discharge sequence control circuit that generates a main gate signal, a starting signal and a simmer control signal;

a main gate driving circuit that drives ON and OFF states of the switching element by receiving a main gate signal;

a starting circuit that impresses high voltage to the starting electrode by receiving a starting signal; and a simmer current supply circuit supplies a simmer current to the discharge lamp when the simmer current supply circuit receives the simmer control signal; wherein the electric discharge sequence control circuit outputs the simmer control signal to the simmer current supply circuit, the simmer current supply circuit supplies the simmer current to the discharge lamp;

the electric discharge sequence control circuit outputs the starting signal to the starting circuit;

the electric discharge sequence control circuit outputs a sequence of the main gate signal corresponding to an alternating repetition of ON and OFF states of the main switching element;

wherein, before or after the sequence ends, the simmer current supply is stopped.

6. The discharge lamp lighting apparatus according to any one of claims 1, 4 and 5, further comprising:

a main gate sequence memory stores ON state continuation period information and OFF state continuation period information with respect to the main switching element, wherein the ON state continuation period information and the OFF state continuation period information are alternatively read out from the main gate sequence memory, and wherein the main gate signal is generated based on the period information alternatively read out from the main gate sequence memory.

7. The discharge lamp lighting apparatus according to any one of claims 1, 4 and 5, further comprising:

a lamp current detection unit for generating a lamp current detection signal by detecting the current which flows into the discharge lamp; and a current target signal generation circuit that generates the lamp current target signal, which is a target waveform signal regarding a value of current flowing into the discharge lamp, wherein the electric discharge sequence control circuit compares the lamp current target signal with the lamp current detection signal and generates information of the ON state continuation period of the main switching element and information of the OFF state continuation period which are respectively realized in an alternating order, by pulse width modulation, so that the difference between the signals becomes small and the main gate signal, which alternatively repeats the ON state continuation period and the OFF state continuation period is generated.

* * * * *

UNITED STATES PATENT AND TRADEMARK OFFICE

CERTIFICATE OF CORRECTION

PATENT NO. : 8,466,630 B2
APPLICATION NO. : 13/064821
DATED : June 18, 2013
INVENTOR(S) : Masashi Okamoto et al.

It is certified that error appears in the above-identified patent and that said Letters Patent is hereby corrected as shown below:

Delete title page with illustrative figure, and replace with new title page with illustrative figure. (attached)

In the Drawings

Figure 1 should be replaced with:

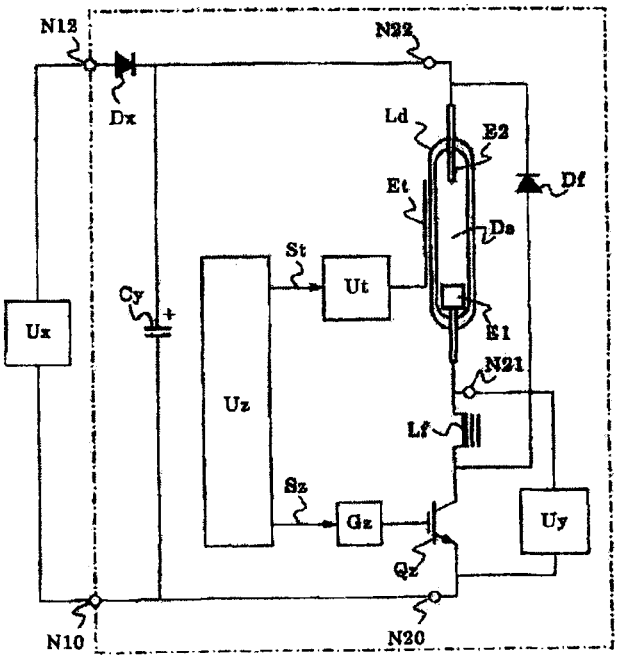

Signed and Sealed this
Fourth Day of August, 2015

Michelle K. Lee

Michelle K. Lee
*Director of the United States Patent and Trademark Office*

(12) United States Patent
Okamoto et al.

(10) Patent No.: US 8,466,630 B2
(45) Date of Patent: Jun. 18, 2013

(54) DISCHARGE LAMP LIGHTING APPARATUS

(75) Inventors: Masashi Okamoto, Hyogo (JP); Masaki Nakamura, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 246 days.

(21) Appl. No.: 13/064,821

(22) Filed: Apr. 19, 2011

(65) Prior Publication Data

US 2011/0254447 A1 Oct. 20, 2011

(30) Foreign Application Priority Data

Apr. 19, 2010 (JP) ..... 2010-095902

(51) Int. Cl.
*H05B 41/32* (2006.01)
*H01J 17/36* (2006.01)

(52) U.S. Cl.
USPC ..... 315/224; 315/84.51; 315/341

(58) Field of Classification Search
USPC ..... 315/84.51, 224, 207, 56, 63, 341, 315/349
See application file for complete search history.

(56) References Cited

U.S. PATENT DOCUMENTS

| | | | | |
|---|---|---|---|---|
| 6,849,831 | B2 | 2/2005 | Timans et al. | |
| 2006/0170375 | A1 * | 8/2006 | Okamoto et al. | 315/291 |
| 2006/0175984 | A1 * | 8/2006 | Okamoto et al. | 315/307 |
| 2009/0166351 | A1 | 7/2009 | Yokomori | |

FOREIGN PATENT DOCUMENTS

| | | | |
|---|---|---|---|
| JP | 2002-198322 | A | 7/2002 |
| JP | 2005-527972 | A | 9/2005 |
| JP | 2009-164080 | A | 7/2009 |

* cited by examiner

*Primary Examiner* Daniel D Chang
(74) *Attorney, Agent, or Firm* — Rader, Fishman & Grauer PLLC

(57) ABSTRACT

A discharge lamp lighting apparatus includes a capacitor, a charge circuit for charging the capacitor, a switching element, a gate driving circuit that controls ON and OFF states of the switching element, a simmer current supply circuit for passing simmer current through a discharge lamp, a starting circuit that impresses high voltage to a starting electrode, and an electric discharge sequence control circuit that generates the gate signal and the starting signal. When lighting the discharge lamp, a sequence of the gate signal corresponding to an alternating repetition of the ON and OFF states of the switching element is generated. Before outputting the starting signal, the switching element is ON as a stand-by state. Then the sequence starts when the starting signal is outputted.

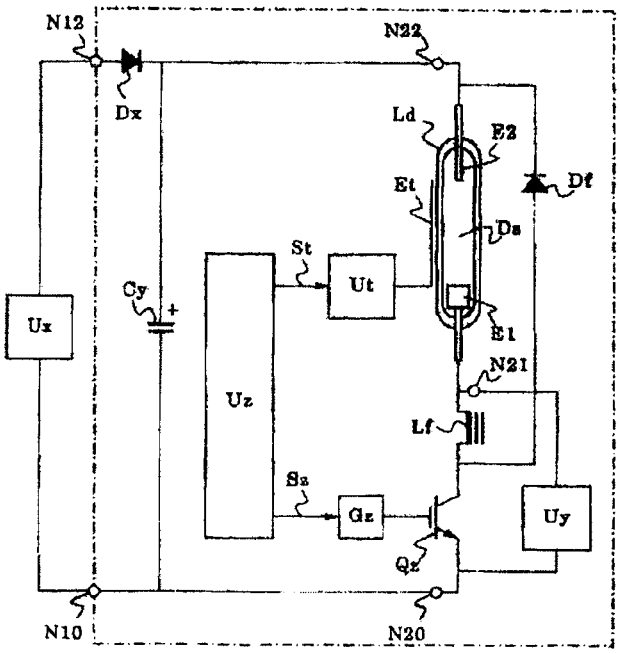

7 Claims, 5 Drawing Sheets